US005175666A

United States Patent [19]

Saito

[11] Patent Number: 5,175,666

[45] Date of Patent: Dec. 29, 1992

[54] CHARGER MAINTAINING A UNIFORM CHARGE IN AN IMAGE FORMING APPARATUS

[75] Inventor: Naomasa Saito, Osaka, Japan

[73] Assignee: Minolta Camera Kabushiki Kaisha, Osaka, Japan

[21] Appl. No.: 453,395

[22] Filed: Dec. 18, 1989

[30] Foreign Application Priority Data

Dec. 20, 1988 [JP] Japan ..... 63-165223[U]

[51] Int. Cl.[5] ..... G03G 15/00

[52] U.S. Cl. ..... 361/225; 355/221; 250/324

[58] Field of Search ..... 361/225, 226, 235; 355/221, 222, 223; 250/324, 325, 326

[56] References Cited

U.S. PATENT DOCUMENTS

| | | | |
|---|---|---|---|
| 3,978,379 | 8/1976 | DelVecchio | 250/324 |
| 4,073,587 | 2/1978 | Selwyn | 361/225 |
| 4,516,848 | 5/1985 | Moriya | 361/225 |
| 4,521,229 | 6/1985 | Baker et al. | 361/230 |
| 4,646,196 | 2/1987 | Reale | 361/225 |

FOREIGN PATENT DOCUMENTS

| | | | |
|---|---|---|---|
| 59-77148 | 5/1984 | Japan . | |
| 59-142581 | 8/1984 | Japan . | |
| 0237569 | 9/1989 | Japan | 335/221 |

*Primary Examiner*—Jeffrey A. Gaffin
*Attorney, Agent, or Firm*—Price, Gess & Ubell

[57] ABSTRACT

In a charger, a plurality of rows of air openings are provided in a shield member. The rows are elongated in the longitudinal direction of stretched corona wires and each of the rows has a plurality of air openings. The air openings are arranged in such a manner that the numbers of the air openings in opposition to the same corona wire in the nearest position are the same when counted in the direction vertical to the length of the corona wire. As a result, soiled portions in the corona wires produced by air streams passing through the air openings are uniformly distributed throughout the whole length of the charger and each part of the charger has substantially the same charging power.

17 Claims, 5 Drawing Sheets

CHARGER MAINTAINING A UNIFORM CHARGE IN AN IMAGE FORMING APPARATUS

BACKGROUND OF THE INVENTION

1. Technical Field of the Invention

The present invention relates to a charger, and particularly to a charger having a plurality of wires used as charging electrodes which are covered by a channel-shaped shield member.

2. Brief Description of the Related Prior Art

For example, in an image forming apparatus of an electrophotographic system, a corona charger is widely used as a means for charging the surface of a photoconductive member. Further, a charger is conventionally known which is provided with a plurality of corona wires so that an increased charging power, necessary for a high speed operation of an image forming apparatus, can be obtained.

In these chargers, a scorotron in which a grid electrode is provided in front of a corona wire and potential is applied to the grid electrode for controlling the charging power or a corotron having no grid electrode is used. A shield member surrounding the corona wire is used as a holder for removably mounting the corona wire in the image forming apparatus.

On the other hand, a charger is conventionally known in which exhaust openings for sucking and exhausting ozone generated by corona discharge therethrough are provided in a shield member surrounding three sides of a corona wire. As shown in FIG. 1, in a charger 20 in which a plurality of corona wires 21*a*, 21*b* are provided in a shield member 22, a plurality of elongated exhaust openings 23 are arranged with an adequate space therebetween in parallel with the corona wires 21*a*, 21*b*.

However, when ozone is sucked through the exhaust openings 23 so as to be exhausted outside, dust such as dispersed toner and paper powder in the machine is also sucked and discharged through the shield member 22. As a result, such dust attaches to the corona wires 21*a*, 21*b*, and portions of the corona wires 21*a*, 21*b* in opposition to the exhaust openings 23 are especially soiled, so that these portions are caused to have a low discharging power. The soiled and therefore low discharging portions of each of the corona wires 21*a*, 21*b* are in the positions adjacent to the exhaust openings 23, and in these positions the photoconductive member is insufficiently charged. As a result, the photoconductive member is charged differently in two kinds of portions. Those are the portions in opposition to the exhaust openings and the portions not in opposition to the exhaust openings, and after development, lines are produced on a recording sheet.

When compulsory exhaustion of gases around a charger is not executed, such a problem as above-mentioned is caused by air discharged from the apparatus or an air stream produced by a cooling fan.

SUMMARY OF THE INVENTION

A main object of the present invention is to provide a charger in which a uniform charging power can be maintained thoughout the whole of the charger even if a number of exhaust openings or other air openings are provided in a shield member of the charger and a corona wire is partly soiled by air streams passing through the openings, whereby the above-mentioned problem of the conventional chargers can be solved.

Another object of the present invention is to provide a charger having a predetermined charging power at any longitudinal position of the charger only by a simple improvement of the relation between the positions of a plurality of rows of air openings arranged in the longitudinal direction of the charger and a corona wire or wires stretched also in the longitudinal direction of the charger.

Further objects of the present invention will become apparent from the following descriptions of the embodiments given with reference to the appended drawings.

BRIEF DESCRIPTION OF THE DRAWINGS

In these embodiments, similar parts are indicated by the same number, and repeated descriptions thereof are omitted.

DETAILED DESCRIPTION OF THE PREFERRED EMBODIMENTS

Now, some embodiments of the present invention will be described with reference to the appended drawings.

FIGS. 2 to 6 show a first embodiment of the present invention, which is applied to a charger used in a laser printer.

Figure 4:
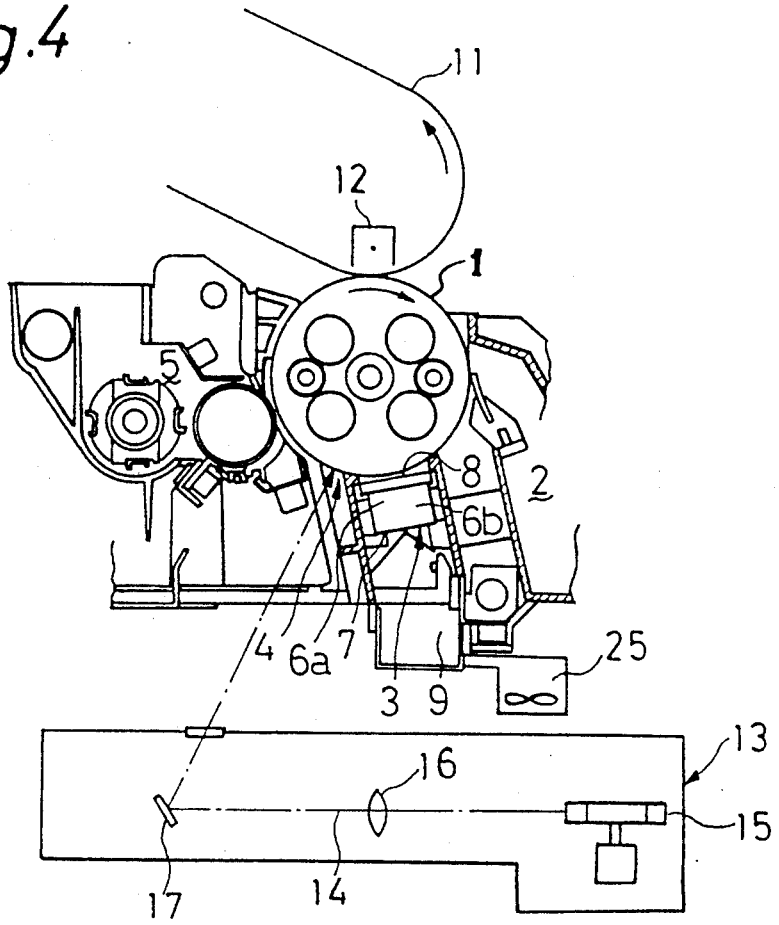
FIG. 4 is a vertically sectioned view of a laser printer in which a charger having exhaust openings is used.

Firstly, referring to FIG. 4, the arrangement of parts of the laser printer around a photoconductive member 1 will be described.

There are provided around the photoconductive member adapted to rotate clockwise, a cleaner 2, a charger 3, an exposure section 4, and a developing device 5. Further, between the developing device 5 and the cleaner 2, a paper feed path 11 is provided so as to be in contact with the photoconductive member 1, and a transfer charger 12 is provided in opposition to the photoconductive member. A recording paper sheet comprises a continuous paper sheet, but it is not limited to this. Below the exposure section 4, a laser optical system 13 is provided. A laser beam 14 modulated in accordance with image signals is emitted from the laser optical system 13, deflected by a polygon mirror 15, corrected by a f ·$\theta$ lens and the like, and projected, through a mirror 16, on the exposure section 4 to expose an image.

Figure 1:
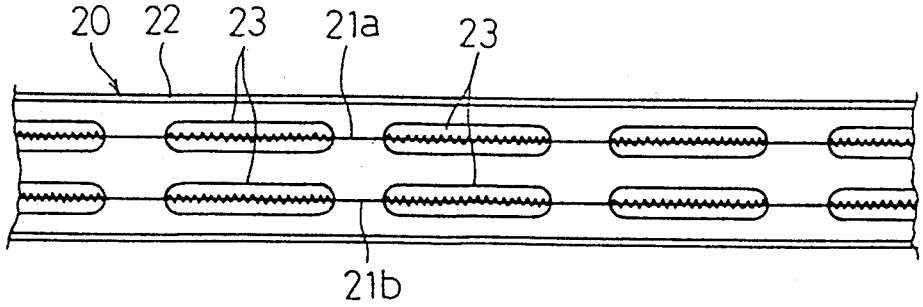
Fig.1 PRIOR ART
FIG. 1 is a plan view of a conventional charger having exhaust openings.
Figure 2:
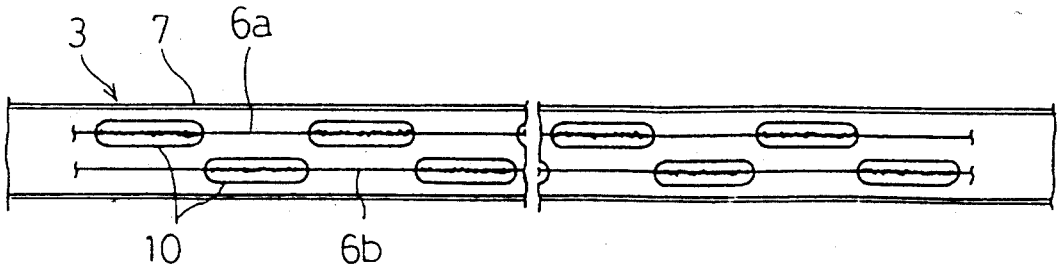
FIG. 2 is a plan view of a first embodiment of the present invention.
Figure 9:
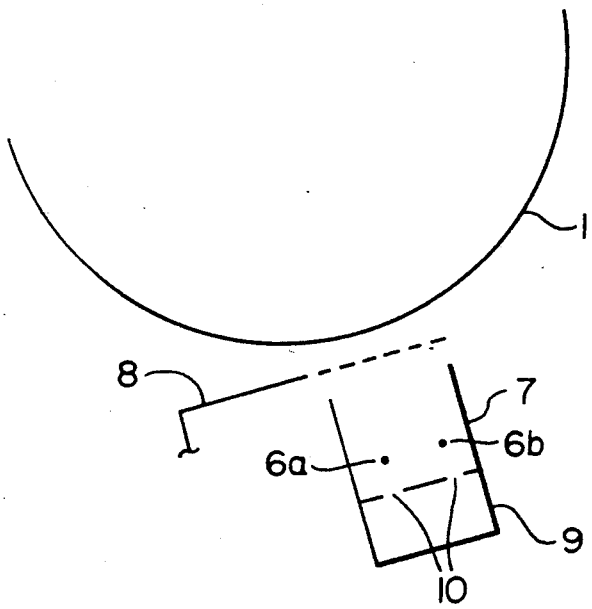
FIG. 9 is a partial schematic cross-sectional view of a charger apparatus.

The charger 3 comprises a channel-shaped shield member 7, a pair of corona wires 6*a*, 6*b* stretched longitudinally in the shield member 7 and in parallel with a back plate of the shield member 7, and a scorotron mesh 8 provided between the corona wires 6a, 6b and the photoconductive member 1. The open part of the shield member 7 of the charger 3 is in opposition to the photoconductive member 1. Behind the shield member 7, an exhaust duct 9 is provided so as to exhaust therethough active gases such as ozone generated by electric discharge, as shown in FIG. 9. Further, as shown in FIG. 2, elongated exhaust openings 10 are provided in the back plate of the shield member 7. The exhaust openings 10 are arranged with equal spaces therebetween, and are formed at the positions immediately behind each of the corona wires 6a, 6b. Further in detail, the exhaust openings 10 are arranged in such a manner in the longitudinal direction of the shield member 7, so that the exhaust openings 10 opposing the corona wires 6a, 6b are formed alternately such that the openings are formed in an alternating fashion. With such an arrangement, at an optional position in the longitudinal direction of the corona wires 6a, 6b, the exhaust openings 10 are not in alignment with one another for the both wires 6a and 6b, but are disposed such that only one corona wire 6a or 6b faces the openings 10 along the longitudinal direction.

The periodicity of the air openings for each row vary from the other rows in order to provide a continual nonaligned corona discharge from at least one wire portion across the entire longitudinal length of the charger assembly to ensure a uniform charge to be applied to the photoconductive layer.

Figure 5:
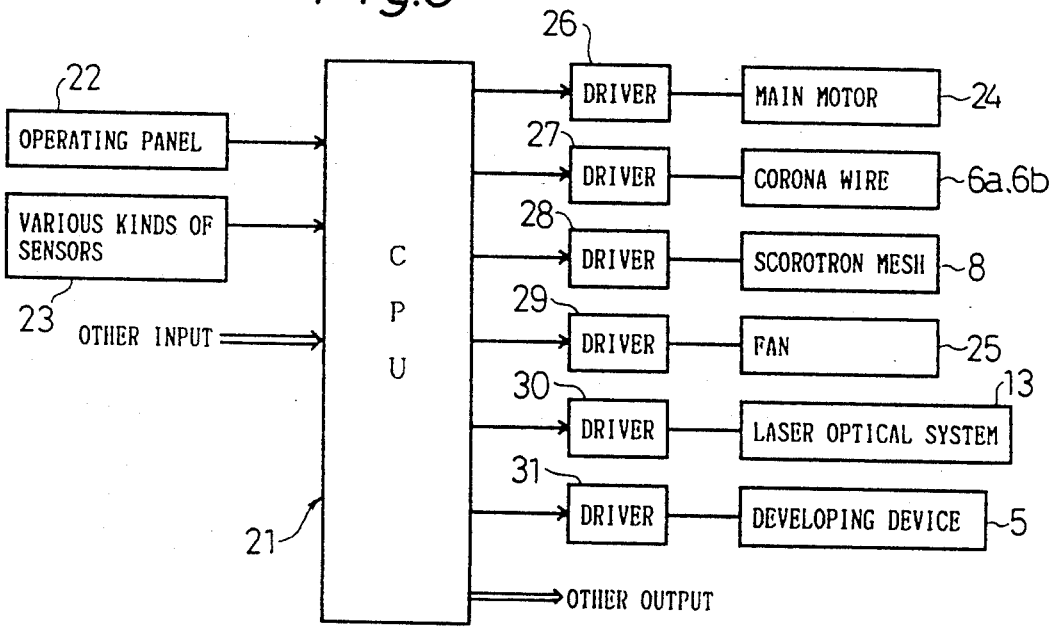
FIG. 5 is a schematic block diagram of a control circuit of the laser printer.

The laser printer of this embodiment is controlled by a control circuit 21 shown in FIG. 5. This control is executed by various kinds of operations on an operating panel 22 and according to a signal from various kinds of sensors 23 provided at respective parts of the printer and other input signals. The printing operation is executed by driving, through each of driver 26 to 31 at correct times, a main motor 24, the corona wires 6a, 6b, a scorotron mesh 8, a fan 25 of the exhaust duct 9, the laser optical system 13, the developing device 5 and others. The outline of these operations are as follows. The photoconductive member 1 is driven to rotate in the direction indicated by an arrow in the figure, so that the outer photoconductive layer thereof is uniformly charged when it passes the charger 3. The charged photoconductive layer is exposed to a laser beam modulated in accordance with image signals which is emitted from the laser optical system 13 at the exposure section 4, whereby an electrostatic latent image is formed. The electrostatic latent image is developed by the developing device 5 to form a toner image. The toner image is transferred and recorded by a transfer charger 12 on a recording sheet fed along the paper feed path 11. The recording sheet is subjected to fixing treatment by means of a fixing device (not shown) and then discharged.

In the charger 3, active gases generated by the electric discharge are exhaused by the fan 25 through the exhaust openings 10 provided in the shield member 7 and discharged outside through the exhaust duct 9.

Figure 3:
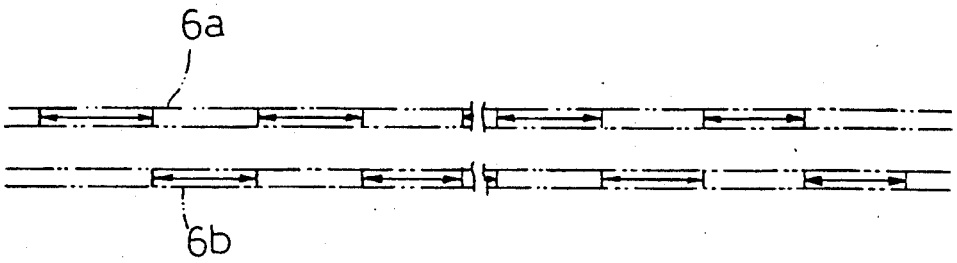
FIG. 3 is an explanatory view of soiled portions of corona wires.

In the initial stage of use of the corona wires 6a, 6b, they are clean and can electrically discharge uniformly throughout their whole lengths and uniformly charge the photoconductive layer. However, as the number of printing operations increase dust such as toner and paper powder dispersed in the printer gradually attaches to the corona wires 6a, 6b, and a large amount of dust attaches to the portions of the corona wires 6a, 6b in opposition to the exhaust openings 10 as shown in FIG. 2. As a result, the discharging powers of the soiled portions of the corona wires 6a, 6b are lowered and the amounts of charge given by the corona wires 6a, 6b become different from each other. However, in this embodiment of the present invention, as shown in FIG. 3, soiled portions (portions indicated by arrows in the figure) of the corona wire 6a and soiled portions of the corona wires 6b are produced in different positions from each other, and therefore, a substantially uniform and predetermined charging power can be obtained throughout the whole of the charger 3.

Figure 6A:
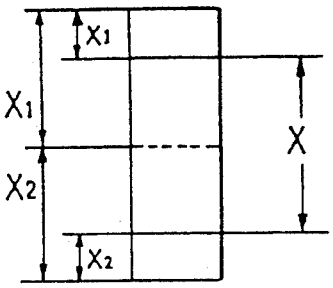
FIG. 6 is an explanatory view of the effect of the charger.
Figure 6B:
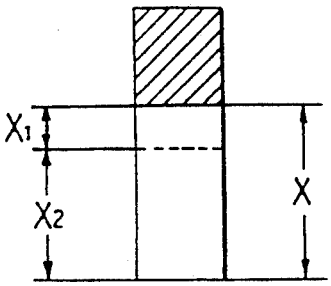
Figure 6C:
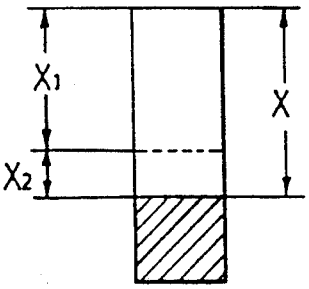

Referring now to schemes of FIG. 6, letter X indicates a charging power required for charging the photoconductive layer to a predetermined surface potential. Letter $X_1$ indicates a charging power obtained by the corona wire 6a, and letter $X_2$ indicates a charging power obtained by the corona wire 6b. FIG. 6(a) shows the state of the corona wires 6a, 6b in the early period of use when they are clean, and difference parts $x_1$, $x_2$ between the sum of $X_1$ and $X_2$ and X flow to scorotron mesh 8 as surplus charging powers. FIG. 6(b) shows the state of the corona wire 6a having soiled portions, and the part marked with oblique lines represents the amount of charging power decreased by the soil of the corona wire 6a. However, in this case, the corona wire 6b is not soiled and charging power thereof does not decrease. Accordingly, the predetermined charging power is maintained. FIG. 6(c) shows the state of the corona wire 6b having soiled portions. In this case, the predetermined level of charging power is maintained similarly to the case of FIG. 6(b). When either of the corona wires 6a, 6b has no soiled portions as above-mentioned, a predetermined charging power can be maintained and a predetermined level of uniformly charged state can be obtained. This advantage can be obtained only by arranging the exhaust openings 10 and the corona wires 6a, 6b in the above-mentioned relation, which neither complicates the structure nor raises the cost of the machine.

Figure 7:
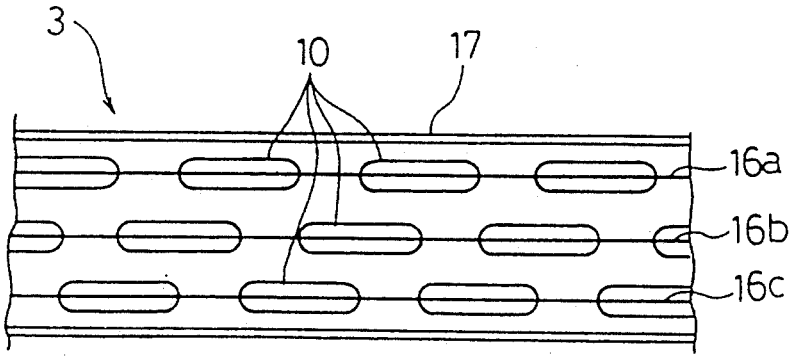
FIG. 7 is a plan view of a charger of a second embodiment of the present invention.

In the charger of the above-mentioned embodiment, two corona wires are used. However, the present invention can be applied to a charger having more than three corona wires 16a, 16b, 16c, — like a second embodiment shown in FIG. 7. In this case, exhaust openings have to be provided in a shield member 17 in such a manner that, at any position in the direction of the lengths of the corona wires, at least one corona wire is not in opposition to any exhaust opening 10, and therefore at least one corona wire has no soiled portion. With such an arrangement, the charger surely has a necessary charging power throughout the whole length thereof and can uniformly charge the photoconductive layer to a predetermined level.

Figure 8:
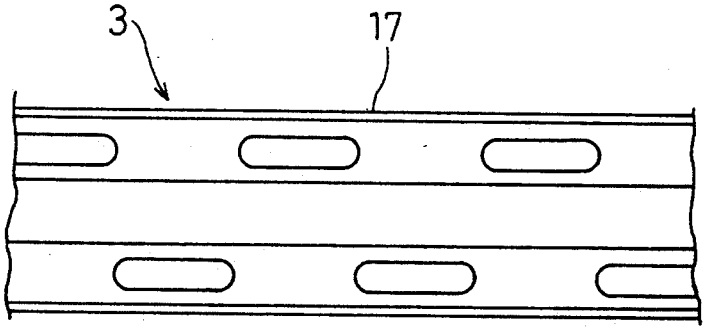
FIG. 8 is a plan view of a charger of a third embodiment of the present invention.

FIG. 8 shows a third embodiment of the present invention. In this embodiment, two rows of exhaust openings 10 are provided in the back plate of a shield member 17 similarly to the case of the first embodiment, but the two rows are largely spaced from each other so that both of the right backs of the two corona wires 6a, 6b are in opposition to this space between two rows of the exhaust openings 10. With this arrangement, each of the corona wires 6a, 6b is soiled by air streams passing through one row of exhaust openings 10 nearest to this corona wires. However, the relation between the positions of the soiled portions of the corona wires 6a, 6b is the same as that of the above-mentioned first embodiment, and occurrence of any nonuniform charging is prevented.

In short, it does not matter how the exhaust openings 10 are in opposition to the corona wires 6*a*, 6*b*, but the exhaust openings 10 have to be arranged in such a specified manner that they provide a predetermined distribution of soiled portions on the corona wires 6*a*, 6*b*. According to the present invention, the arrangement of the corona wires and the exhaust openings is not limited if it can satisfy the above-mentioned requirement.

A scorotron system is used in the above-mentioned embodiment. However, the same advantage can be obtained when a corotron system is used. Further, in the above-mentioned embodiment, the present invention is applied to a charger for charging a photoconductive member. However, it can be similarly applied to a transfer charger and a discharging charger. Further, if the exhaust openings are provided in a side plate of a shield member and a similar problem of soil of corona wires occurs, the present invention can be also applied, irrespective of the presence of a back plate.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A charger used in an image forming apparatus, comprising:

a plurality of corona wires disposed in parallel with each other;

a shield member which surrounds the plurality of corona wires except for at least parts of the corona wires respectively in opposition to a member to be charged; and a plurality of air openings provided in the shield member, the air openings being arranged in a plurality of rows elongated in the longitudinal direction of the corona wires and so formed in an alternating fashion along the rows so that a periodicity of air openings for each row varies from each of the other rows and a uniform charge is maintained across an effective length of the charger.

2. A charger as claimed in claim 1, wherein the air openings are provided in a part of the shield member on the opposite side of the member to be charged with respect to the corona wires.

3. A charger as claimed in claim 1, wherein the air openings are exhaust openings, and the charger further comprises a suction means for sucking air around the corona wires through the exhaust openings.

4. A charger as claimed in claim 1, wherein the number of the corona wires is equal to the number of the rows of air openings.

5. A charger as claimed in claim 1, further comprising a scorotron mesh provided on the corona wires at the side of the member to be charged.

6. A charger used in an image forming apparatus, comprising:

a plurality of corona wires disposed in parallel with each other;

a shield member which covers the plurality of corona wires except at least across parts of the corona wires respectively in opposition to a member to be charged; and a plurality of air openings provided in the shield member, the air openings being arranged in only a plurality of first and second rows elongated in the longitudinal direction of the corona wires so that one row is positioned relative to one corona wire and the other row is positioned relative to another corona wire, the air openings being formed alternately along the rows so that all of the air openings in the first row are displaced in their periodicity from the air openings in the second row, and a uniform charge is applied to a photoconductive surface over the life of the charger.

7. A charger as claimed in claim 6, wherein the air openings are provided in a part of the shield member at the opposite side of the member to be charged with respect to the corona wires.

8. A charged as claimed in claim 6, wherein the air openings are exhaust openings.

9. A charger as claimed in claim 6, wherein the air openings are exhaust openings, and the charger further comprises a suction means for sucking air around the corona wires through the exhaust openings.

10. A charger as claimed in claim 6, wherein the number of the corona wires is equal to the number of the rows of air openings.

11. A charger as claimed in claim 6, further comprising a scorotron mesh provided on the corona wires on the side of the member to be charged.

12. A charger used in an image forming apparatus, comprising:

a plurality of corona wires disposed in parallel with each other;

a shield member surrounding the plurality of corona wires on one side where the corona wires are in opposition to a member to be charged; and a plurality of air openings formed in the shield member for exhausting air around the corona wires, the air openings being arranged in a plurality of rows so that the number of the openings formed in the shield member are the same as viewed in the direction traverse to the longitudinal direction of the corona wires, and a periodicity of air openings for each row varies from the other rows to ensure a uniform charge despite any soiling of the corona wires.

13. A charger as claimed in claim 12, wherein the air openings are arranged in a plurality of rows elongated in the longitudinal direction of the corona wires.

14. A charger as claimed in claim 13, wherein the number of the corona wires is equal to the number of the rows of the air openings.

15. A charger as claimed in claim 12, wherein the air openings are exhaust openings, and the charger further comprises a suction means for sucking air around the corona wires through the exhaust openings.

16. A charger as claimed in claim 12, further comprising a scorotron mesh provided on the corona wires on the side of the member to be charged.

17. An improved charger assembly for use in an image forming apparatus having a photoconductive layer comprising:

a plurality of corona wires, and a shield member positioned adjacent the corona wires and extending along longitudinal axes of the corona wires, the shield member having a plurality of spaced exhaust openings, to permit air discharge, positioned relative to the respective corona wires so that their size and arrangement along a longitudinal axis of the shield member ensures that at least a portion of each one of the corona wires, along a traverse direction to the longitudinal axis, is always substantially and periodically out of alignment with a corresponding spaced exhaust opening in order to provide a continual nonaligned corona discharge from such respective wire portions across the entire longitudinal length, and a composite length of the out-of-alignment wire portions, resulting from a sum of each of the lengths of the out-of-alignment wire portions, will approximately equal the length of the effective corona discharge of the charger assembly, whereby a uniform charge can be applied to the photoconductive layer as it moves traversely to the longitudinal axis.

* * * * *